US010197253B2

(12) United States Patent
Pahl et al.

(10) Patent No.: US 10,197,253 B2
(45) Date of Patent: Feb. 5, 2019

(54) LUMINAIRE HAVING AN ADJUSTABLE TORSION SPRING

(71) Applicant: Focal Point, LLC, Chicago, IL (US)

(72) Inventors: Scott Pahl, Lisle, IL (US); Ken Czech, Naperville, IL (US); Josue Moctezuma, Lake Beach, IL (US); Zach Payne, Chicago, IL (US); Edwin Vice, Jr., Chicago, IL (US)

(73) Assignee: Focal Point, LLC, Chicago, IL (US)

( * ) Notice: Subject to any disclaimer, the term of this patent is extended or adjusted under 35 U.S.C. 154(b) by 456 days.

(21) Appl. No.: 15/143,062

(22) Filed: Apr. 29, 2016

(65) Prior Publication Data

US 2017/0314770 A1 Nov. 2, 2017

(51) Int. Cl.

| | |
|---|---|
| ***F21S 8/02*** | (2006.01) |
| ***F21V 17/00*** | (2006.01) |
| ***F21V 21/16*** | (2006.01) |
| ***F21V 7/00*** | (2006.01) |

(52) U.S. Cl.

CPC ..... *F21V 21/16* (2013.01); *F21S 8/026* (2013.01); *F21V 7/00* (2013.01); *F21V 17/002* (2013.01)

(58) Field of Classification Search

CPC ..... F21V 21/16; F21V 21/18; F21V 21/02; F21V 21/047; F21V 21/048; F21V 21/049; F21V 21/14; F21S 8/026

See application file for complete search history.

(56) References Cited

U.S. PATENT DOCUMENTS

| | | | | |
|---|---|---|---|---|
| 6,095,660 | A * | 8/2000 | Moriyama | F21S 8/026 362/147 |
| 6,554,457 | B1 * | 4/2003 | Platt | F21V 19/04 362/269 |
| 8,070,328 | B1 * | 12/2011 | Knoble | F21V 3/00 362/311.02 |
| 8,408,759 | B1 * | 4/2013 | Rashidi | F21S 8/026 362/373 |
| 2009/0080189 | A1 * | 3/2009 | Wegner | F21S 8/02 362/235 |
| 2012/0044704 | A1 * | 2/2012 | Wilson | F21S 8/026 362/365 |
| 2013/0294095 | A1 * | 11/2013 | Thompson, III | F21S 8/02 362/373 |
| 2014/0049957 | A1 * | 2/2014 | Goelz | F21V 29/763 362/235 |
| 2015/0252988 | A1 * | 9/2015 | Rashidi Doust | F21V 21/049 362/285 |

* cited by examiner

*Primary Examiner* — William N Harris

(74) *Attorney, Agent, or Firm* — Banner & Witcoff, Ltd.

(57) ABSTRACT

A luminaire includes an adjustable torsion spring assembly for mounting the light engine assembly to a mounting frame and for providing the ability to conduct maintenance of the light engine assembly. The luminaire may include a mounting frame assembly; an light engine assembly engaged with at least a portion of the mounting frame assembly, the light engine assembly comprising at least one light source configured to emit light; and a support wire adjustably-coupled at a first end to a side of the light engine assembly, the support wire extending in the first direction from the side of the light engine assembly, and comprising at least one hook at a second end.

15 Claims, 8 Drawing Sheets

LUMINAIRE HAVING AN ADJUSTABLE TORSION SPRING

BACKGROUND

Maintenance and upgrading of a downlight luminaire may create difficulties. Advantageously, various parts may limit the relative motion of a luminaire relative to the mounting frame assembly such that electrical parts and other components are not damaged or otherwise strained by a weight of a light engine hanging from the luminaire. A luminaire with a mounting frame may include one or more elements configured to facilitate maintenance or upgrading of the luminaire and may allow a light engine or light source to be removed from the luminaire.

BRIEF SUMMARY

According to one aspect, a torsion spring assembly for use with a luminaire to allow a light engine assembly to be removed from the luminaire is disclosed. The torsion spring assembly may comprise an adjustable plate coupled to a light engine assembly and a support wire engaged with the adjustable plate. The support wire may include a single-length of wire wrapped around a mounting structure located on the adjustable plate, thereby forming a first end and a second end, wherein the first end and the second end each comprise a hook structure. The adjustable plate may provide at least two positions which the adjustable plate may slide in order to vary the relative distance between the mounting structure and the light engine assembly to accommodate ceilings of various thicknesses. Additionally, the hooks of the support wire may be configured to be received by a portion of a mounting frame assembly of the luminaire to limit a travel of the light engine assembly relative to the portion of a mounting frame assembly upon uncoupling the light engine assembly from the portion of a mounting frame assembly.

According to another aspect, a luminaire may include a mounting frame assembly; a light engine assembly engaged with the mounting frame assembly; and a support wire adjustably-coupled at a first end to a side of the light engine assembly. The light engine assembly may comprise at least one light source configured to emit light. The support wire may extend in the first direction from the side of the light engine assembly. The support wire may comprise at least one hook at a second end. The at least one hook of the support wire may be configured to be received by a portion of a mounting frame assembly to limit a travel of the light engine assembly relative to the mounting frame assembly upon uncoupling the light engine assembly from the mounting frame assembly. Additionally, the support wire may be coupled at the first end to an adjustable plate, with the adjustable plate providing at least two positions along the first direction for adjustable coupling to the support wire to the side of the light engine assembly to accommodate various ceiling thicknesses.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

Aspects of this disclosure relate to a luminaire that includes an adjustable torsion spring assembly for mounting a light engine assembly to a mounting frame and for providing the ability to conduct maintenance of the light engine assembly. The luminaire may include a mounting frame assembly; an light engine assembly engaged with the mounting frame assembly, the light engine assembly comprising at least one light source configured to emit light; and a support wire adjustably-coupled at a first end to a side of the light engine assembly, the support wire extending in the first direction from the side of the light engine assembly, and comprising at least one hook at a second end.

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

Figure 1:
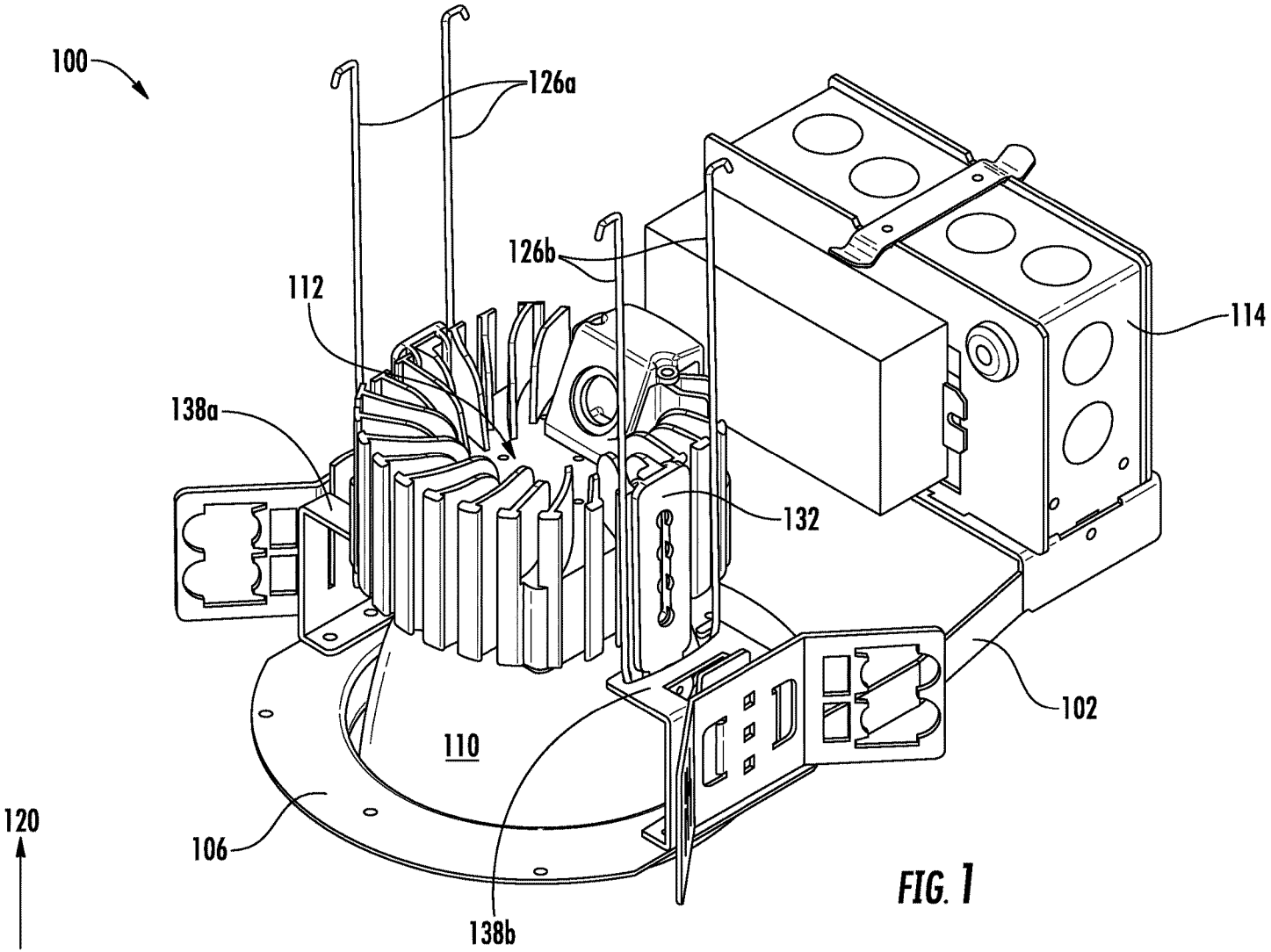
FIG. 1 depicts an isometric view of an example luminaire, according to one or more aspects described herein.

FIG. 1 depicts an isometric view of an example luminaire 100, according to one or more aspects described herein. The luminaire 100 may comprise a mounting frame assembly 102 and an aperture plate 106 that is coupled to the mounting frame assembly 102. A reflector assembly 110 may be slidably engaged with, and removably-coupled to, a light engine assembly 112. The light engine assembly 112 may be coupled to the aperture plate 106 and/or the mounting frame assembly 102 in any variety of ways without departing from this invention. Additionally, the luminaire 100 and/or light engine assembly 112 may be any luminaire or light engine assembly 112 without departing from this invention. The specific luminaire 100 and/or light engine assembly 112 shown in these figures may not be utilized with this invention and other forms or designs of luminaries 100 and/or light engine assemblies 112 may be utilized.

Figure 2:
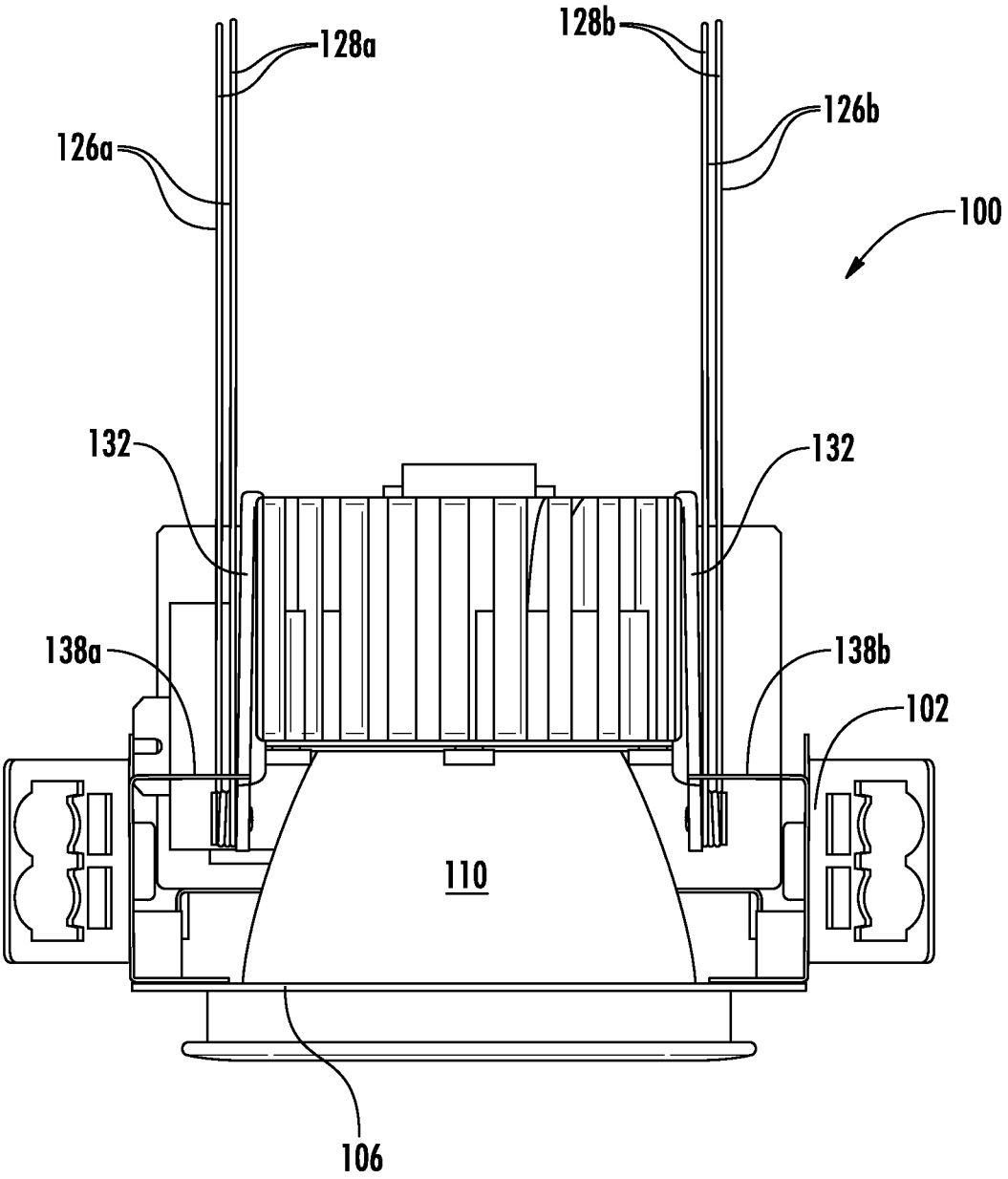
FIG. 2 depicts a front view of the example luminaire of FIG. 1, according to one or more aspects described herein.
Figure 3:
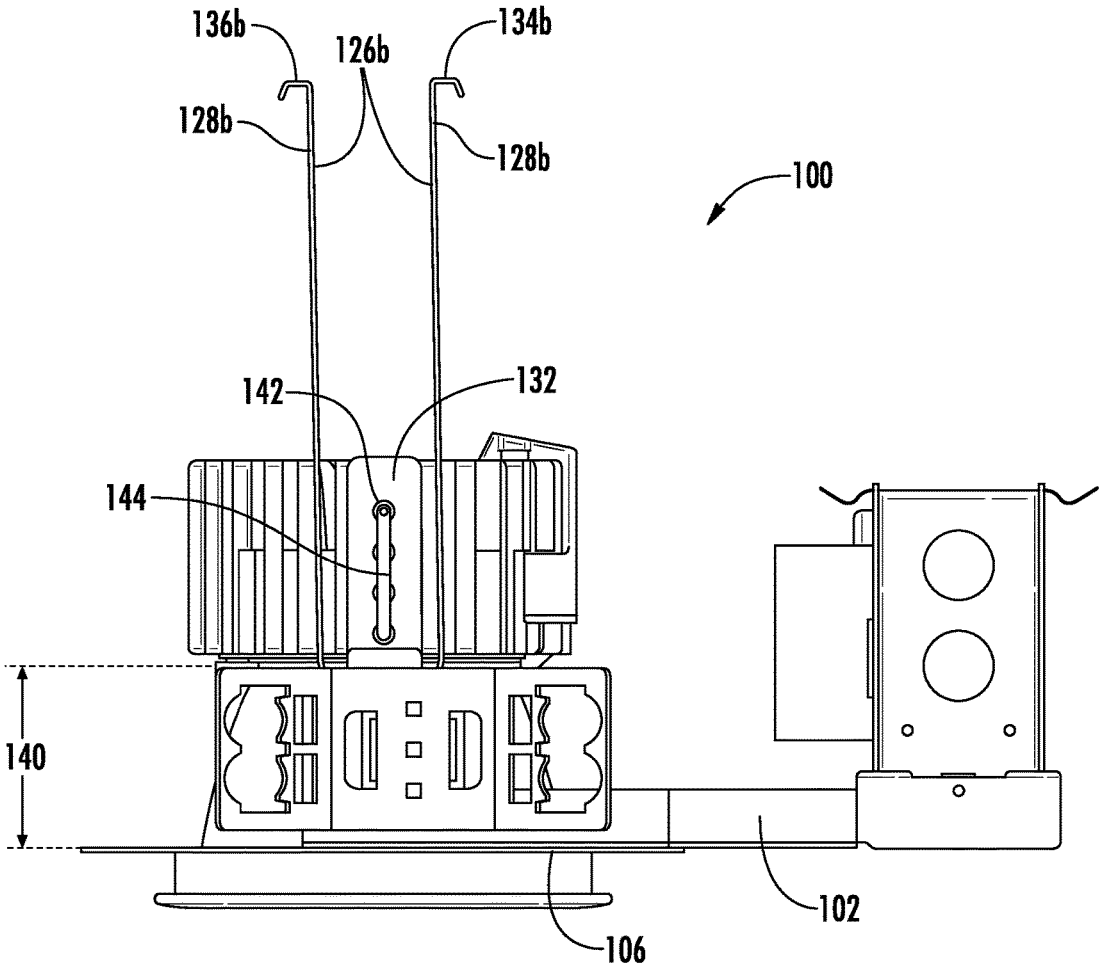
FIG. 3 depicts a side view of the example luminaire of FIG. 1, according to one or more aspects described herein.
Figure 4:
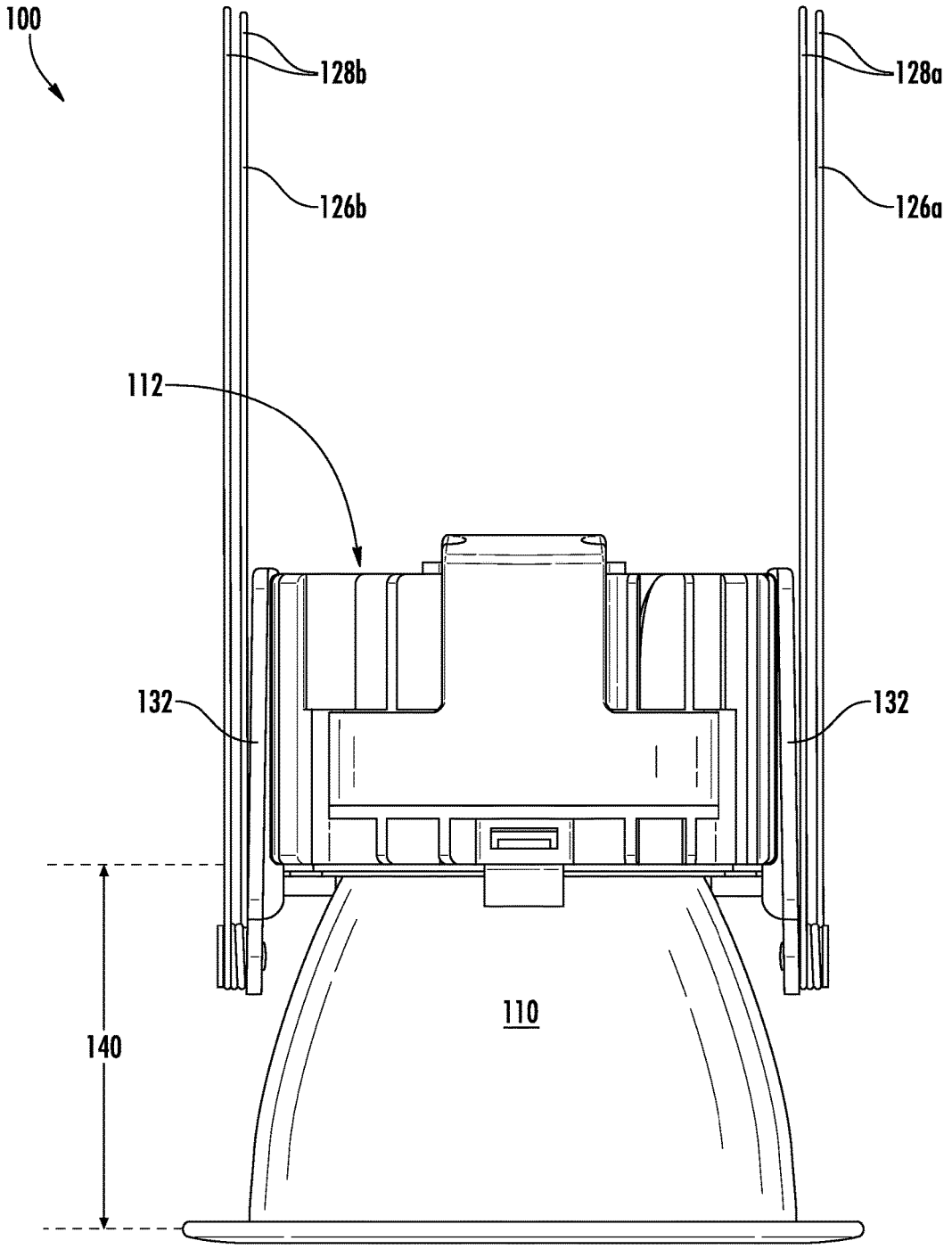
FIG. 4 depicts an elevation view of the light engine assembly of FIG. 1, according to one or more aspects described herein.

FIGS. 2 and 3 depict different views of the example luminaire 100, according to one or more aspects described herein. In particular, FIG. 2 depicts a front view and FIG. 3 depicts a side view of the luminaire 100. The luminaire 100 may comprise one or more elements configured to facilitate maintenance or upgrading of the luminaire post installation (e.g. after the mounting frame assembly 102 has been coupled to an external support structure (e.g. ceiling structure, among others).

In one example, the one or more elements configured to facilitate maintenance or upgrading of the luminaire may allow a light engine or light source to be removed from the luminaire 100. Accordingly, the luminaire 100 may have a support wire 124. The support wire 124 may comprise two separate support wires, such as support wire 126*a* and/or support wire 126*b*. The support wires 126*a*, 126*b* may be adjustably-coupled at a first end (e.g. first end 128*a* of support wire 126*a* and first end 128*b* of support wire 126*b*) to a side of the light engine assembly 112 (e.g. see FIG. 3). In one example, the support wire 126*b* may comprise a single length of wire wrapped around a mounting structure 130 of an adjustable plate 132. As such, the support wire 124 may be referred to as a torsion spring 124. In this way, the single length of wire may form two ends. In one example, the two ends of the support wire 126*a* may each comprise a hook structure (e.g. hook structure 134*a* and hook structure 136*a*). Similarly, the two ends of the support wire 126*b* may each comprise a hook structure (e.g. hook structure 134*b* and hook structure 136*b*). Accordingly, the reflector assembly 110 and light engine assembly 112 may be configured to translate in an up or down direction, relative to the mounting frame assembly 102 along that direction indicated by arrow 120 (e.g. move in the direction of arrow 120, or in the opposite direction, otherwise referred to as the negative direction to that arrow 120).

As such, the support wires 126*a* and 126*b* may be configured to limit a travel (e.g. a translation, or a relative range of motion) of the light engine assembly 112 relative to the mounting frame assembly 102. In this way, the hook structures 134*a*, 134*b*, 136*a*, and 136*b* may travel along that direction 120 (or 180° to arrow 120) until being received by a portion of the mounting frame assembly 102. In particular, the hook structures 134*a*, 134*b*, 136*a*, and 136*b* may be configured to abut surfaces 138*a* and 138*b* of the mounting frame assembly 102.

Figure 7A:
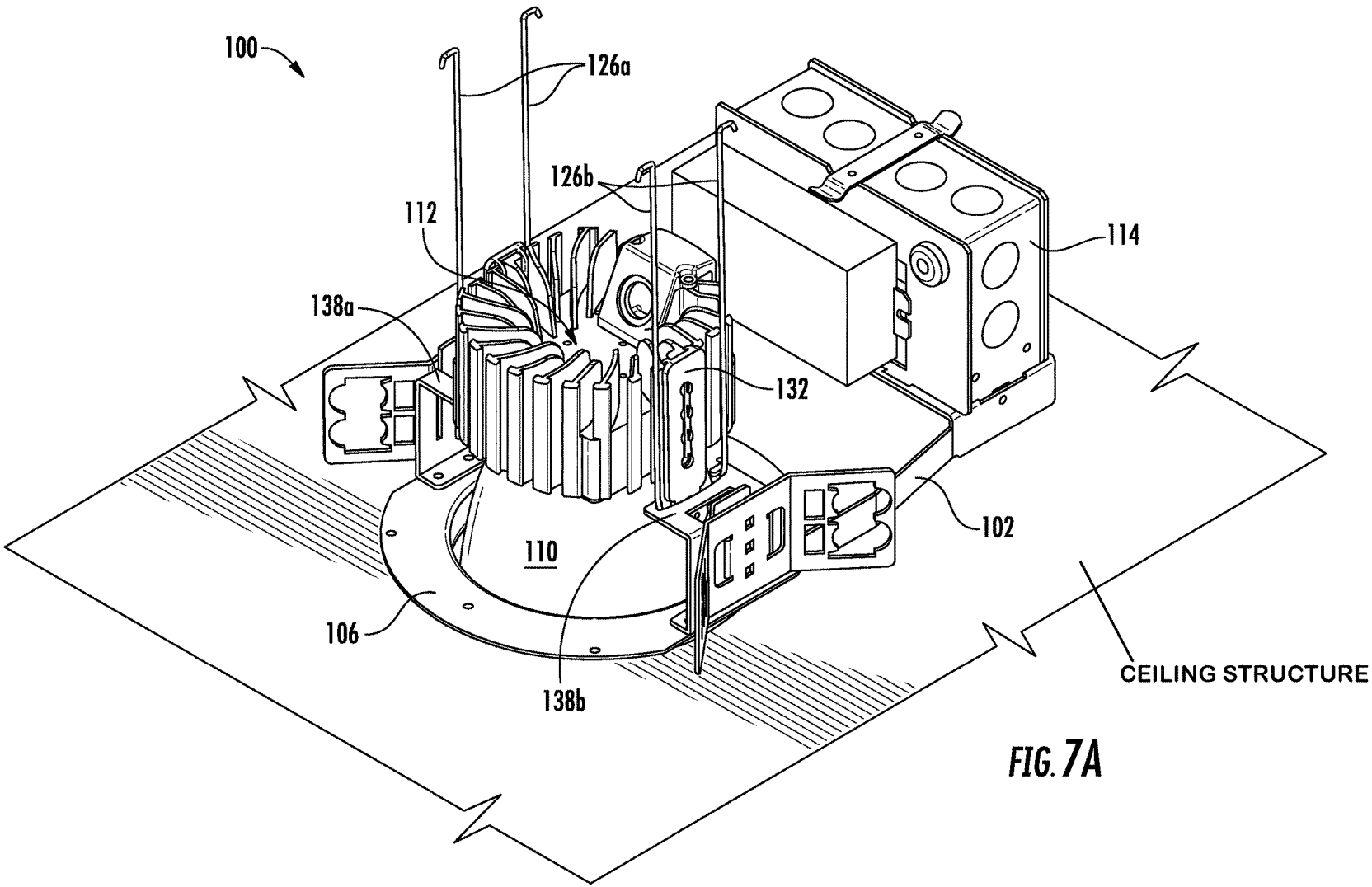
FIGS. 7A-7C depict a isometric views of an example luminaire during various phases of operation, according to one or more aspects described herein.
Figure 7B:
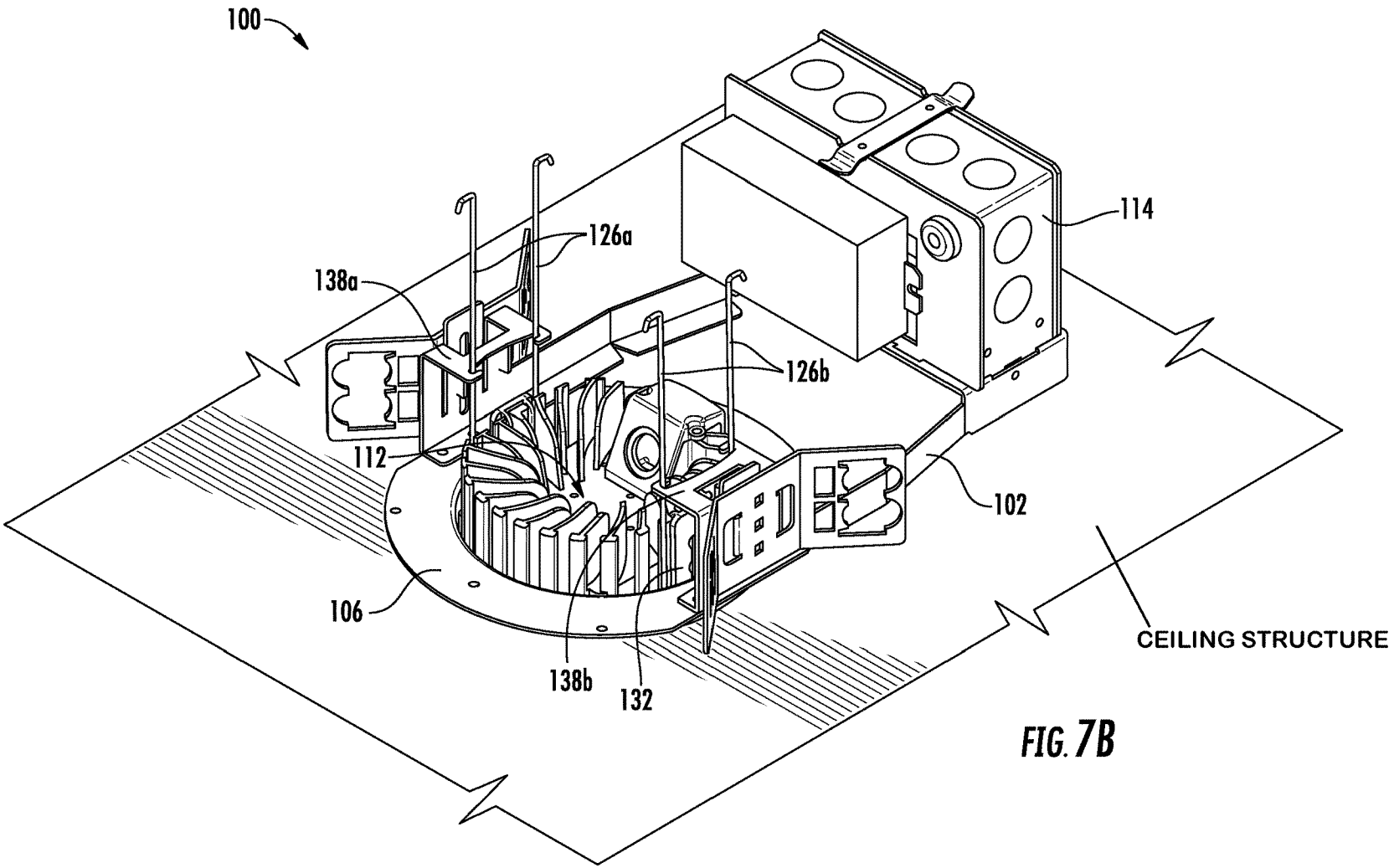
Figure 7C:
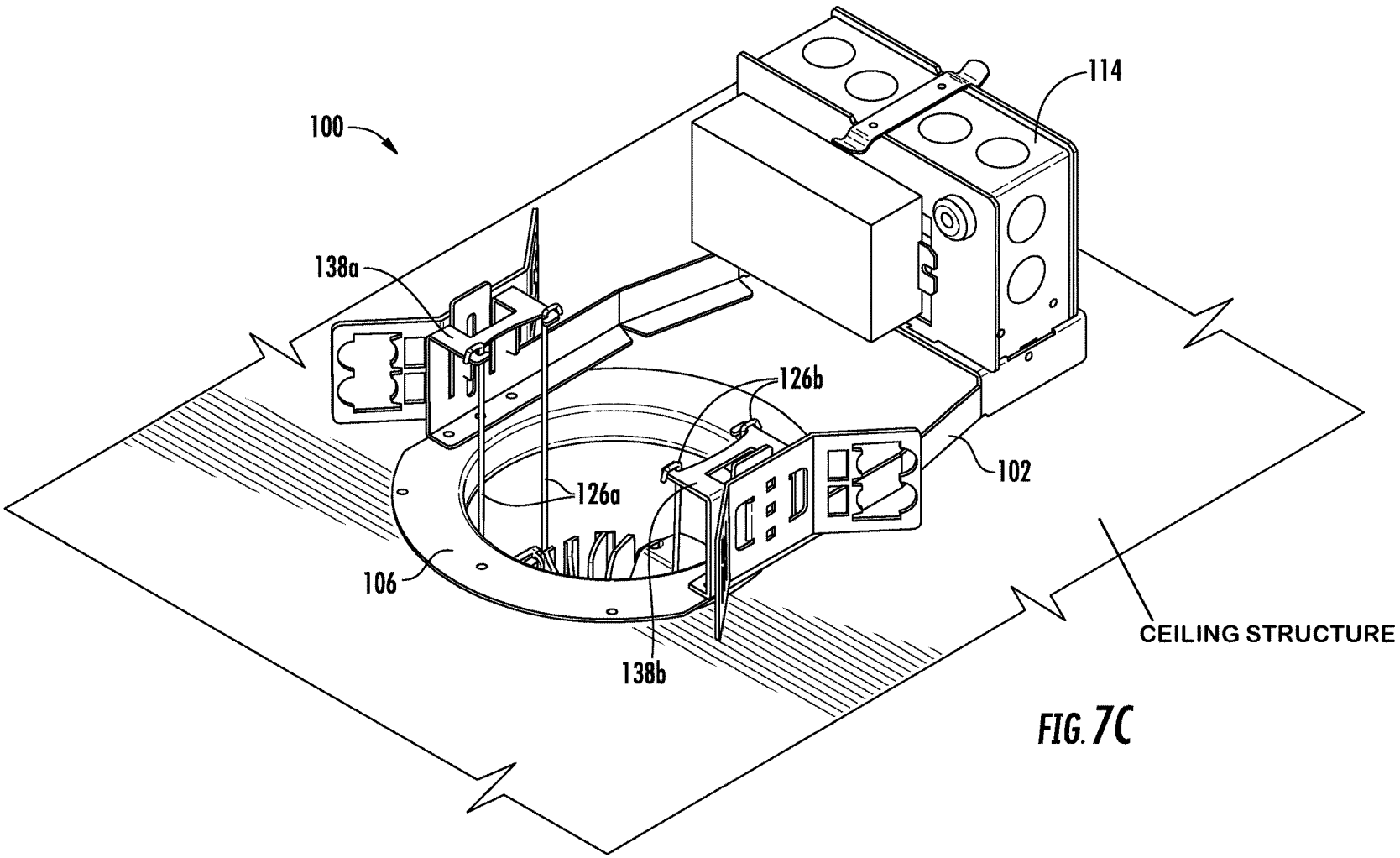

In one example, the support wires 126*a* and 126*b* may allow the light engine assembly 112 to be lowered below a ceiling plane (as illustrated in FIGS. 7A-7C), above which the luminaire 100 is installed. In this way, one or more maintenance or upgrading operations may be carried out on the luminaire 100. For example, the circuit board or light sources may be repaired or replaced. Advantageously, the support wires 126*a* and 126*b* may limit the relative motion of the light engine assembly 112 (as well as one or more of the circuit board and the reflector assembly 110) relative to the mounting frame assembly 102 such that electrical wiring extending between the junction box 114 and the light engine assembly 112 (not pictured) may not be damaged or otherwise strained by a weight of the light engine assembly 112 (and/or circuit board and the reflector assembly 110) hanging from the luminaire 100.

The luminaire 100 may be configured to accommodate reflectors, similar to reflector assembly 110, having different geometries and sizes. In one example, reflector assembly 110 may have a height dimension 140. Accordingly, height 140 may correspond to a distance between a top of the reflector assembly 110 (or a bottom of light engine assembly 112) and a plane approximately within which the reflector assembly 110 is removably-coupled to the mounting frame assembly 102 (i.e. a plane associated with the aperture plate 106). However, alternative reflectors that may be utilized with the light engine assembly 112 may have differing values for height 140. As such, the adjustable plate 132 may be configured to provide at least two positions along direction 120 between which the support wire (e.g. support wire 126*a* or 126*b*) may be coupled to the light engine assembly 112. In one implementation, the adjustable plate 132 may provide at least two positions between which the adjustable plate 132 may slide in order to vary the relative distance between the mounting structure 130 and the light engine assembly 112 to accommodate ceilings of various thicknesses. In another implementation, the adjustable plate 132 may provide infinite adjustability between two end stops.

Figure 5:
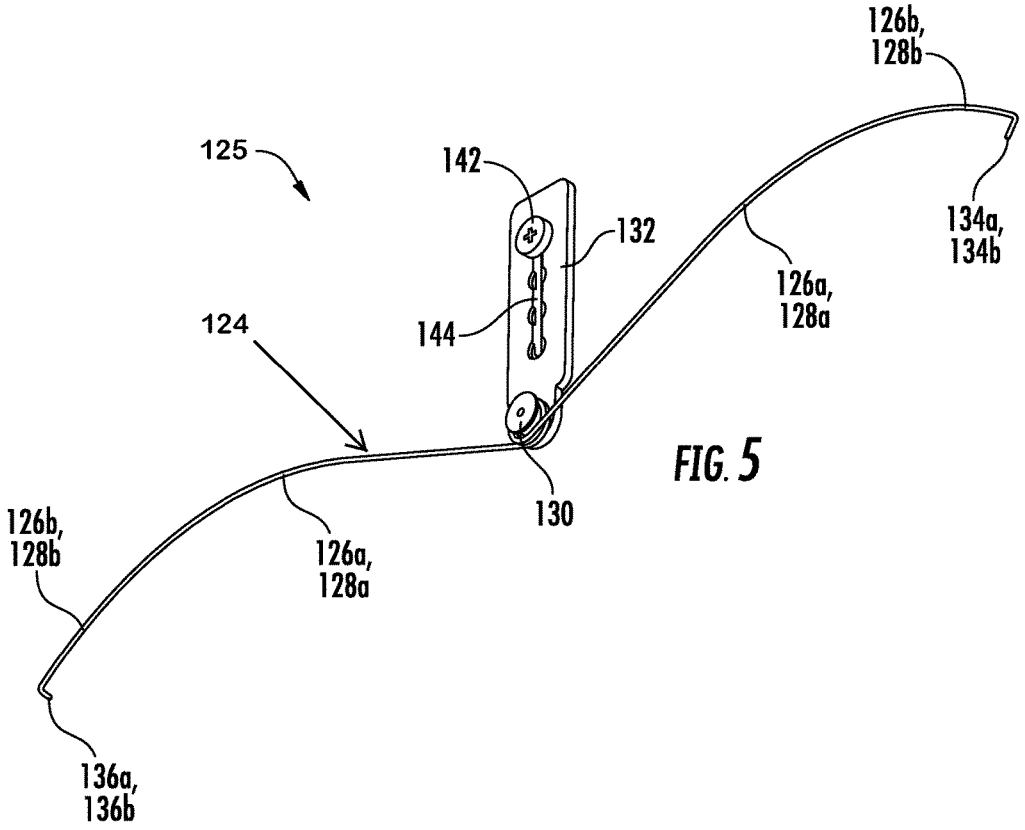
FIG. 5 depicts a perspective view of a torsion spring from the luminaire of FIG. 1, according to one or more aspects described herein.
Figure 6:
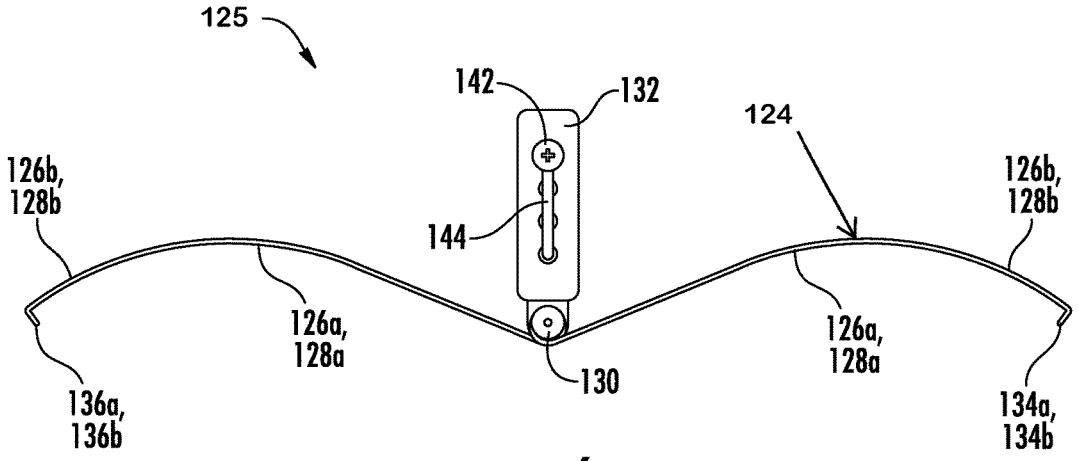
FIG. 6 depicts a front view of the torsion spring from FIG. 5, according to one or more aspects described herein.

FIGS. 5 and 6 depict an example torsion spring 124 and torsion spring assembly 125. FIG. 5 depicts a perspective view of the torsion spring assembly 125 from the luminaire of FIG. 1. FIG. 6 depicts a front view of the torsion spring assembly 125 from FIG. 5. As illustrated in FIGS. 5 and 6, the torsion spring assembly 125 includes a torsion spring 124 with an adjustable plate 132 with a support wire 126*a*, 126*b* engaged with the adjustable plate 132.

The adjustable plate 132 may be rectangular in shape. The adjustable plate 132 may be other shapes without departing from this invention. The adjustable plate 132 may include a fastener 142 and a slot 144. The fastener 142 may be loosened to slide in slot 144 and then tightened to then lock the fastener 142 in place in the slot 144. Utilizing the fastener 142 and the slot 144, the adjustable plate 132 may be configured to provide at least two positions along the slot between which the support wire 126*a*, 126*b* may be coupled to the light engine assembly 112. The adjustable plate 132 illustrated in FIGS. 5 and 6 provides four different positions between which the fastener 142 may slide within the slot 144 and the adjustable plate 132. In another implementation, the adjustable plate 132 may provide at least two or three different positions between which the fastener 142 may slide within the slot 144 and the adjustable plate 132. In another implementation, the adjustable plate 132 may provide an infinitely adjustable number between the two ends of the slot 144. Each of the different positions of adjustability with the fastener 142 and the slot 144 and the adjustable plate 132 provide the ability to vary the relative distance between the mounting structure 130 and the light engine assembly 112 to accommodate ceilings of various thicknesses.

FIGS. 5 and 6 also show the support wires 126*a*, 128*a* engaged with the adjustable plate 132. The adjustable plate 132 may also include a mounting structure 130 with which the support wires 126*a*, 128*a* are wrapped around to secure the support wires 126*a*, 128*a* to the adjustable plate 132. As was explained above and shown in FIGS. 5 and 6, the support wires 126*a*, 128*a* include two ends 126*b*, 128*b*. The two ends 126*b*, 128*b* include a set of two pairs of hook structures 134*a*, 136*a* and 134*b*, 136*b*. The hook structures 134*a*, 134*b*, 136*a*, and 136*b* may be configured to abut surfaces 138*a* and 138*b* of the mounting frame assembly 102 to hold a luminaire and/or light engine within the mounting frame assembly 102 in order to change the light source or provide other maintenance activities.

FIGS. 7A-7C depict isometric views of the example luminaire 100 showing the ceiling structure. As illustrated in FIGS. 7A-7C, the torsion spring assembly 125 and support wires 126*a* and 126*b* may allow the light engine assembly 112 to be lowered below the ceiling structure or ceiling plane, above which the luminaire 100 is installed. In this way, one or more maintenance or upgrading operations may be carried out on the luminaire 100. FIG. 7A illustrates the luminaire 100 with the torsion spring assembly 125 fully installed in the ceiling structure/plane. FIG. 7B illustrates the luminaire 100 with the light engine assembly 112 and the torsion spring assembly 125 lowered approximately halfway down below the ceiling plane. As illustrated in FIG. 7B, the support wires 126*a* and 126*b* of the torsion spring assembly 125 slides through the surfaces 138*a*, 138*b* to limit the downward movement of the light engine assembly 112. FIG. 7C illustrates the luminaire 100 with the light engine assembly 112 and the torsion spring assembly 125 fully lowered below the ceiling plane. As illustrated in FIG. 7C, the support wires 126*a* and 126*b* of the torsion spring assembly 125 and the hook structures 134*a,b* and 136*a,b* on the surfaces 138*a*, 138*b* to facilitate maintenance or upgrading operations that may be carried out on the light engine assembly 112 and the luminaire 100.

In the foregoing, reference is made to the various elements as having one or more of a "top," "bottom," "front," "back," "left," and/or "right" side, and/or a "horizontal," or "vertical" orientation. However, these terms are merely associated with one example orientation used to aid in the description of the various elements of this disclosure. As such, the disclosed implementations in the foregoing are not limited to any one orientation. Similarly, the various elements described throughout this disclosure may be scaled in proportion to one another, such that the various implementations described herein may have any dimensional values. In another example, one or more elements described in this disclosure may be scaled disproportionately, and such that the accompanying Figures may not represent true proportions of the various elements described herein.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A torsion spring assembly for use with a luminaire to allow a light engine assembly to be removed from the luminaire, the torsion spring assembly comprising:

an adjustable plate coupled to a light engine assembly; and a support wire engaged with the adjustable plate, wherein the support wire includes a single-length of wire wrapped around a mounting structure located on the adjustable plate, thereby forming a first end and a second end, wherein the first end and the second end each comprise a hook structure, and further wherein the adjustable plate provides at least two positions which the adjustable plate may slide in order to vary a relative distance between the mounting structure and the light engine assembly to accommodate ceilings of various thicknesses.

2. The torsion spring assembly of claim 1, wherein the hook structures of the support wire are configured to be received by a portion of a mounting frame assembly of the luminaire to limit a travel of the light engine assembly relative to the portion of the mounting frame assembly upon uncoupling the light engine assembly from the portion of the mounting frame assembly.

3. The torsion spring assembly of claim 1, wherein the at least two positions include a first position for a first ceiling thickness and a second position for a second ceiling thickness different than the first ceiling thickness.

4. The torsion spring assembly of claim 1, wherein the adjustable plate includes a fastener and a slot to provide the at least two positions, wherein the fastener is loosened to slide in the slot and then tightened to lock the fastener in place in the slot.

5. The torsion spring assembly of claim 1, wherein the adjustable plate provides four positions which the adjustable plate may slide in order to vary the relative distance between the mounting structure and the light engine assembly to accommodate ceilings of various thicknesses.

6. The torsion spring assembly of claim 1, wherein the adjustable plate provides an infinite number of adjustable positions, with each of the different adjustable positions providing the ability to vary the relative distance between the adjustable plate and the light engine assembly to accommodate ceilings of various thicknesses.

7. The torsion spring assembly of claim 1, wherein the adjustable plate is rectangular-shaped.

8. A luminaire, comprising:

a mounting frame assembly;

a light engine assembly engaged with the mounting frame assembly, the light engine assembly comprising at least one light source configured to emit light; and a support wire adjustably-coupled at a first end to a side of the light engine assembly, the support wire extending in a first direction from the side of the light engine assembly, and comprising at least one hook at a second end, wherein the at least one hook of the support wire is configured to be received by a portion of the mounting frame assembly to limit a travel of the light engine assembly relative to the mounting frame assembly upon uncoupling the light engine assembly from the mounting frame assembly.

9. The luminaire of claim 8, wherein the support wire is coupled at the first end to an adjustable plate, the adjustable plate provides at least two positions along the first direction for adjustable coupling to the support wire to the side of the light engine assembly to accommodate various ceiling thicknesses.

10. The luminaire of claim 9, wherein the at least two positions include a first position for a first ceiling thickness and a second position for a second ceiling thickness different than the first ceiling thickness.

11. The luminaire of claim 9, wherein the adjustable plate includes a fastener and a slot to provide the at least two positions, wherein the fastener is loosened to slide in the slot and then tightened to lock the fastener in place in the slot.

12. The luminaire of claim 11, wherein the adjustable plate provides an infinite number of adjustable positions between the slot, with each of the different adjustable positions providing the ability to vary the relative distance between the adjustable plate and the light engine assembly to accommodate ceilings of various thicknesses.

13. The luminaire of claim 9, wherein the adjustable plate provides four positions along the first direction for adjustable coupling to the support wire to the side of the light engine assembly to accommodate various ceiling thickness.

14. The luminaire of claim 9, wherein the adjustable plate is rectangular-shaped.

15. The luminaire of claim 8, wherein the at least one hook abuts a surface of the mounting frame assembly to hold the light engine assembly within the mounting frame assembly.

* * * * *